United States Patent [19]

Swaskey

[11] 4,045,346

[45] Aug. 30, 1977

[54] BASEMENT SEWER TRAP

[76] Inventor: Henry S. Swaskey, 2720 Hamilton Ave., Export, Pa. 15632

[21] Appl. No.: 660,874

[22] Filed: Feb. 24, 1976

[51] Int. Cl.[2] ..... E03F 5/06

[52] U.S. Cl. ..... 210/164; 210/247; 137/247.33; 137/247.39

[58] Field of Search ..... 137/247.11, 247.35, 137/247.39; 210/163, 164, 247

[56] References Cited

U.S. PATENT DOCUMENTS

| | | | |
|---|---|---|---|
| 267,264 | 11/1882 | Schill | 210/247 |
| 873,120 | 12/1907 | Dunstan | 137/247.39 |
| 1,070,773 | 8/1913 | Callahan | 137/247.35 X |

FOREIGN PATENT DOCUMENTS

| | | | |
|---|---|---|---|
| 3,680 of | 1888 | United Kingdom | 137/247.39 |

*Primary Examiner*—Harold W. Weakley

[57] ABSTRACT

This device consists primarily of a coupling sleeve for a sewer pipe, and on the interior of the coupling sleeve is supported a cup or well, and on the interior of the cup is supported, a funnel tube beneath a water strainer. The water flows through the strainer, down through the funnel tube, upwards out of the cup portion, and finally, down the open end of the coupling sleeve, into the sewer pipe.

1 Claim, 3 Drawing Figures

FIG. 2
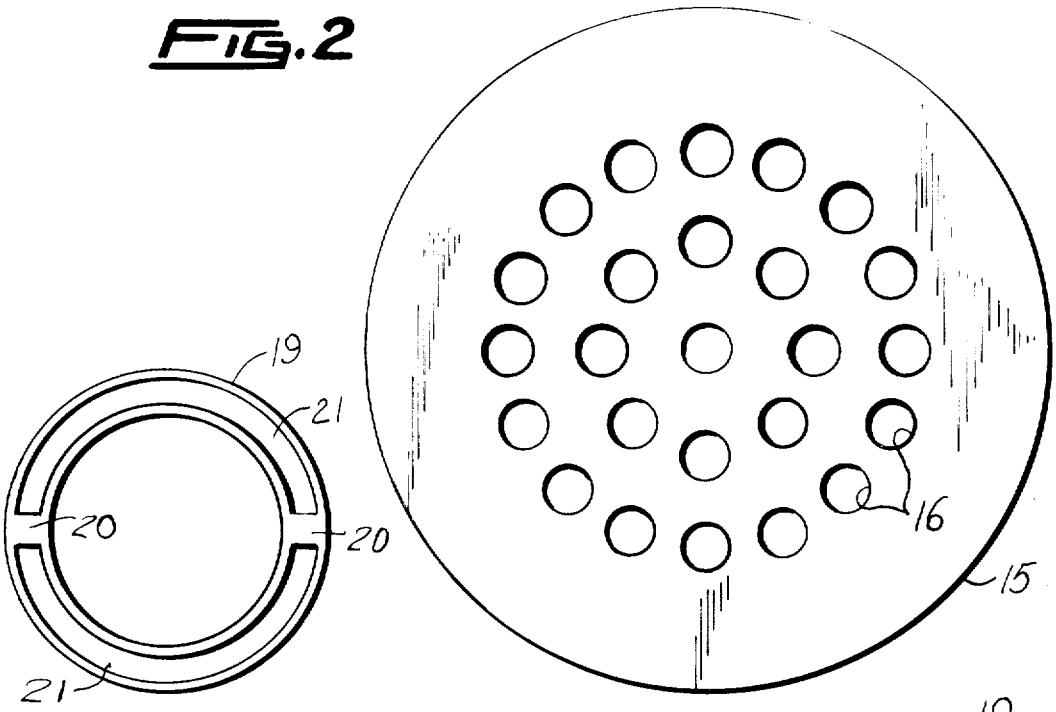
FIG. 3
FIG. 1
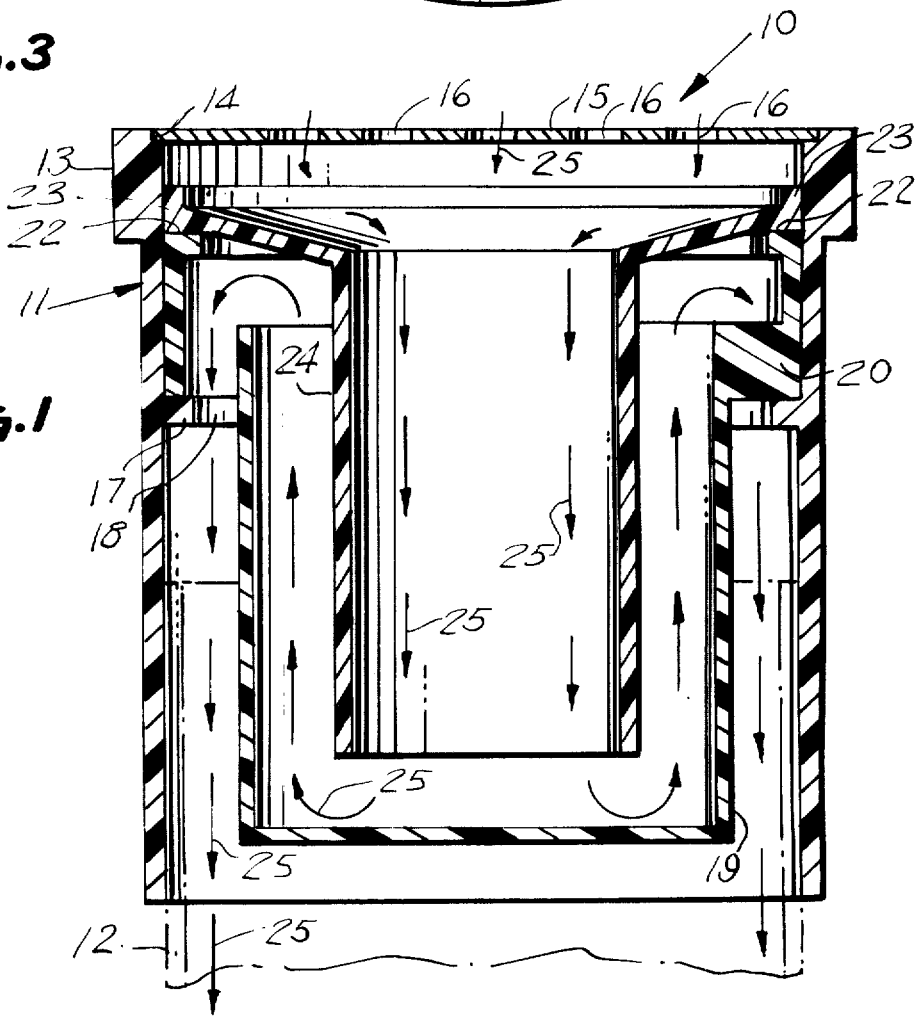

BASEMENT SEWER TRAP

This invention relates to plumbing devices, and more particularly to a basement sewer trap.

It is therefore the principal object of this invention to provide a basement sewer trap, which may be easily installed with vertical or horizontal connections, and will be one hundred percent odor free at all times.

Another object of this invention is to provide a basement sewer trap which will be of such structure, so that the fast or slow water feeding into the device, will not siphon or lower the water level in the well or cup portion of the device, so as to maintain a much longer sewer gas protection.

Another object of this invention is to provide a trap of the type described, of which the components may vary in length, if desired for longer protection.

A further object of this invention is to provide a sewer trap, of the type described, which may be adaptable for use under basement showers, and under laundry tubs.

Other objects of the invention are to provide a basement sewer trap which is simple in design, inexpensive to manufacture, rugged in construction, easy to use and efficient in operation.

These and other objects will be readily evident upon a study of the following specification and the accompanying drawing, wherein:

FIG. 1 is a vertical view of the present invention, shown in section with the sewer pipe shown in phantom lines;

FIG. 2 is a plan view of the water strainer shown removed from FIG. 1;

FIG. 3 is a top plan view of the cup or well portion of the device shown on a smaller scale and removed from the assembly of FIG. 1.

According to this invention, a trap 10 is shown to include a plastic coupler sleeve 11, which fits onto sewer pipe 12. A flange 13 on one end of sleeve 11, is provided with an angular recessed shoulder 14, which provides support means for a removable water strainer 15 having a plurality of spaced apart openings 16 for the flow of water therethrough. Sleeve 11 is provided with an inner wall 17, which is molded integral of sleeve 11. Wall 17 is provided with a central opening 18, in which is freely received a plastic cup 19 having spaced apart web portions 20, which define a pair of openings 21, for the flow of water. An internal flange 22 of cup 19 provides support means and seating means for flange 23 of plastic funnel tube 24, the lower portion of the funnel tube 24 being freely received within the cup 19. The flow of water is indicated by the arrows 25.

It shall be noted, that the outer peripheral surface of cup 19 seals against the inner peripheral surface of coupler sleeve 11, and the flange 23, of funnel tube 24, seals against the inner periphery of the flange 13 area of sleeve 11. The water flow filters the openings 16 of strainer 15, and travels downwards through the funnel tube 24. The water flow then rises upwards on the outer periphery of the funnel tube 24, after which the flow is downwards through the opening 21, and between the outer periphery of cup 19 and the inner periphery of coupler sleeve 11.

What I now claim is:

1. A basement sewer trap, comprising in combination, a cylindrical coupler sleeve, a radially inwardly flange on an inner face of said sleeve located along an intermediate portion of said inner face, a portion of said inner face below said flange fitting around an upper end of a sewer pipe, a portion of said inner face above said flange fitting an outer periphery of a cylindrical ring of a plastic cup which is supported on said coupler sleeve inward flange, said plastic cup including a cylindrical side wall, a circular bottom wall at a lower end of said cup side, and said ring being concentrically spaced around an upper edge of said cup, said plastic cup depending downwardly into a center of an upper end of said sewer pipe, said cup ring being joined with said cup side wall by a pair of diametrically spaced apart webs therebetween, a funnel tube of cylindrical shape being concentrically within said cup, an upper edge of said funnel tube being integral with a radially outwardly conically-shaped flange which at its outer periphery fits said inner face of said coupler sleeve and rests upon an upper edge of said cup ring, and an upper end of said coupler sleeve having a circular recess in which is fitted a circular water strainer having a plurality of openings therethrough, for drain water to pass therethrough, then down through said funnel tube, then up in said cup around an outer side of said funnel tube, then over a top of said cup and down through spaces between said cup side wall and said cup ring so as to flow down around an outer side of said cup side wall and down into said sewer pipe.

* * * * *